US008359985B2

(12) United States Patent
Wangdak

(10) Patent No.: US 8,359,985 B2
(45) Date of Patent: Jan. 29, 2013

(54) MODULAR COMPONENTS FOR CONSTRUCTING LARGER SYSTEM

(76) Inventor: Lama Pema Wangdak, Cresskill, NJ (US)

( * ) Notice: Subject to any disclaimer, the term of this patent is extended or adjusted under 35 U.S.C. 154(b) by 485 days.

(21) Appl. No.: 12/348,828

(22) Filed: Jan. 5, 2009

(65) Prior Publication Data

US 2010/0170174 A1 Jul. 8, 2010

(51) Int. Cl.
*A47B 13/00* (2006.01)

(52) U.S. Cl. ..... 108/158.12; 312/263; 312/265.5; 312/111

(58) Field of Classification Search ..... 312/263, 312/265.5, 265.6, 108, 111, 195; 108/153.1, 108/157.1, 157.13–157.14, 158.12; 403/381
See application file for complete search history.

(56) References Cited

U.S. PATENT DOCUMENTS 2,366,677 A * 1/1945 Rosenthal ..... 108/60
3,069,216 A * 12/1962 Vaeth ..... 108/158.12
3,195,507 A * 7/1965 Miller ..... 119/431
4,067,165 A * 1/1978 Timmons ..... 52/585.1
4,153,311 A * 5/1979 Takahashi ..... 312/107
4,582,002 A * 4/1986 Wright ..... 108/60
4,807,539 A * 2/1989 Del Castillo von Haucke ..... 312/265.5
4,832,421 A * 5/1989 Shoffner ..... 312/263
4,941,717 A * 7/1990 Beaulieu ..... 312/265.3
5,117,989 A * 6/1992 Ross ..... 108/180
5,863,030 A * 1/1999 Kotler et al. ..... 256/24
6,174,116 B1 * 1/2001 Brand ..... 410/140
6,532,878 B2 * 3/2003 Tidemann ..... 108/158.12
6,557,955 B2 5/2003 Saravis
6,595,378 B2 7/2003 Wang
6,845,871 B1 1/2005 Culp
7,546,811 B2 * 6/2009 Owen ..... 108/180

OTHER PUBLICATIONS

International Search Report on Patentability and Written Opinion dated Mar. 15, 2010.

* cited by examiner

*Primary Examiner* — Hanh V Tran
(74) *Attorney, Agent, or Firm* — Seth D. Levy; Nixon Peabody LLP

(57) ABSTRACT

A modular component, panel, or building block, is used to construct modular styled systems. Such module contains specifically designed slots or openings. Such slots extend substantially perpendicular from the modules' edges and into the center of the panel. The interlocking mechanism provided by the slots allows the modules to be combined to form a modular styled system. The module further contains a number of drill holes that runs across its edges and can be threaded with metal rods for structural support.

21 Claims, 14 Drawing Sheets

MODULAR COMPONENTS FOR CONSTRUCTING LARGER SYSTEM

BACKGROUND OF THE INVENTION

1. Field of the Invention

The present invention relates to the construction of modular styled system such as furniture, supports, organizers, and toys, from modular components, panels, or building blocks. Specifically, it relates to the design, manufacture, and utilization of such modular components, panels or building blocks, each having specifically designed slots or openings.

2. Discussion of the Related Art

A piece of furniture is made of different components of different sizes and shapes. As disclosed in prior art references such as U.S. Pat. No. 3,811,728, a furniture assembly begins with a set of different sized and shaped modules such as furniture bases that has one particular shape, furniture top surfaces, and other additional components such as walls. To interconnect the various modular components, the various components often have a periphery accessory structure. For example, a top surface may be recessed with several criss-crossed slots. The top surface is also recessed along the four sides of its perimeter with slender, rectangular openings. For coupling two such modules together, inverted-U shaped clips are employed, with legs having cross-sections in the shape of slender rectangles, for insertion one apiece into the slender, rectangular openings of the top surfaces. Thus two modules can be coupled together to build a modular assembly of a furniture base. This known furniture assembly further includes several kinds of auxiliary components, for releasably coupling with the furniture base. Some additional auxiliary components are needed to couple with the furniture base to build chair or sofa assemblies. Still others are needed to build table, shelf or bed assemblies. For coupling purposes, each auxiliary component has a downwardly extending, stubby flange looped around in a rectangle, for insertion into the criss-crossed network of slots in the top surfaces of the furniture base There is a need to reduce the number of modular components that is needed to construct a piece of furniture, for everyday use as well as modern day travelers and urban residents. There is also a need to pack the modular components more efficiently so that the dismantled components of a modular style furniture or object can be easily transferred, or stored to create living space. For example, packing the modular components in a compact manner would allow users, such as in schools, homes, apartment, business, studio spaces, a multipurpose access to the floor space. Imagine a "room" that can be converted into empty space for exercise, or a dining-room or a bedroom. When stored, there is also need for a modular component to blend into the surrounding area without the intrusion into the floor space.

There is an additional environmental need for modern day travelers and urban resident to loan, share, and moved in parts among the users. A standardized modular component allows for reuse and sharing. It also allows for mass production.

SUMMARY OF THE INVENTION

Embodiments of the present invention relate the utilization of modular panels, components, objects, and/or building blocks to construct a modular styled system, such as pieces of furniture, supports, organizers and toys. One example of such modular panel, component, object, and/or building block is a rectangular or square object that has a) predetermined length and width, b) various set combinations of carved-out openings or slots that extend perpendicular from the edges of such panels, and/or c) a set number of drill-holes with specific diameters and their lengths. Such modular panel can be solid or hollow, and can be constructed from any material, such as wood, metal, glass, plastic, etc. This modular panel can be used as a building block of various viable accessories such as tables of various sorts, shelves, beds, and book stands etc. This modular panel can be used to also construct de novo structures for a given time and situation.

Embodiments of the present invention provide a plurality of modular elements for building pieces of furniture, supports, organizers, toys and other objects that can be easily dismantled, compacted neatly so that a big storage place is not needed, and they can be conveniently transported.

Embodiments of the present invention further provide modular furniture, support, organizer, toy pieces formed from individual modular units that do not require the use of tools, fasteners, or the like for assembly.

The above and other aspects, features and advantages of embodiments of the present invention will be more apparent from the following more particular description thereof, presented in conjunction with the following drawings.

BRIEF DESCRIPTION OF THE DRAWINGS

FIG. 1 shows various embodiments of a modular panel of the present invention. FIG. 2 shows a perspective view of two modular panels of the embodiments of present invention interlocked to construct a larger system in the form of a furniture component.

FIG. 4 shows various a perspective views of different panel designs according to different embodiments of the present invention.

FIG. 5 shows a cross-sectional views of different panel designs according to different embodiments of the present invention.

DETAILED DESCRIPTION OF THE PREFERRED EMBODIMENTS

The following description is not to be taken in a limiting sense, but is made merely for the purpose of describing the general principles of the embodiments described herein. The scope of the invention should be determined with reference to the claims. The embodiments of the present invention address the problems described in the background while also addressing other additional problems as will be seen from the following detailed description.

Figure 1A:
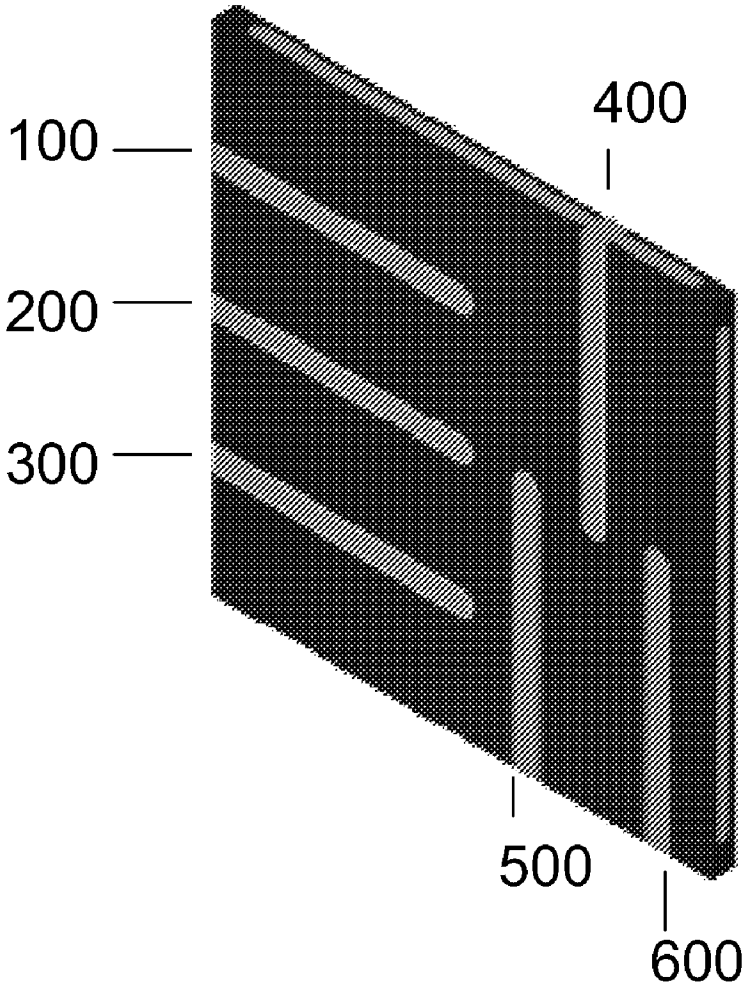
FIG. 1*a* shows a solid panel that is made from wood and FIG. 1*b* shows a hollowed panel that is made of metal
Figure 1B:
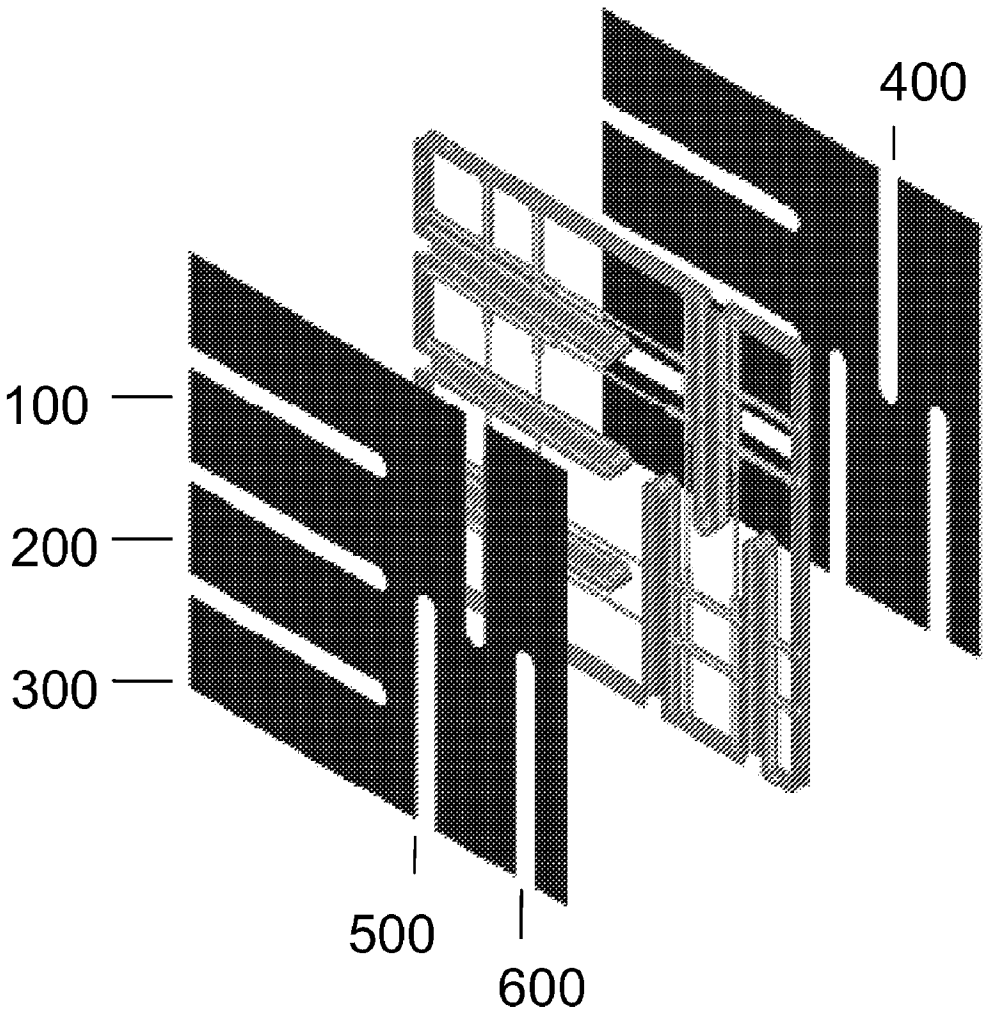
Figure 2A:
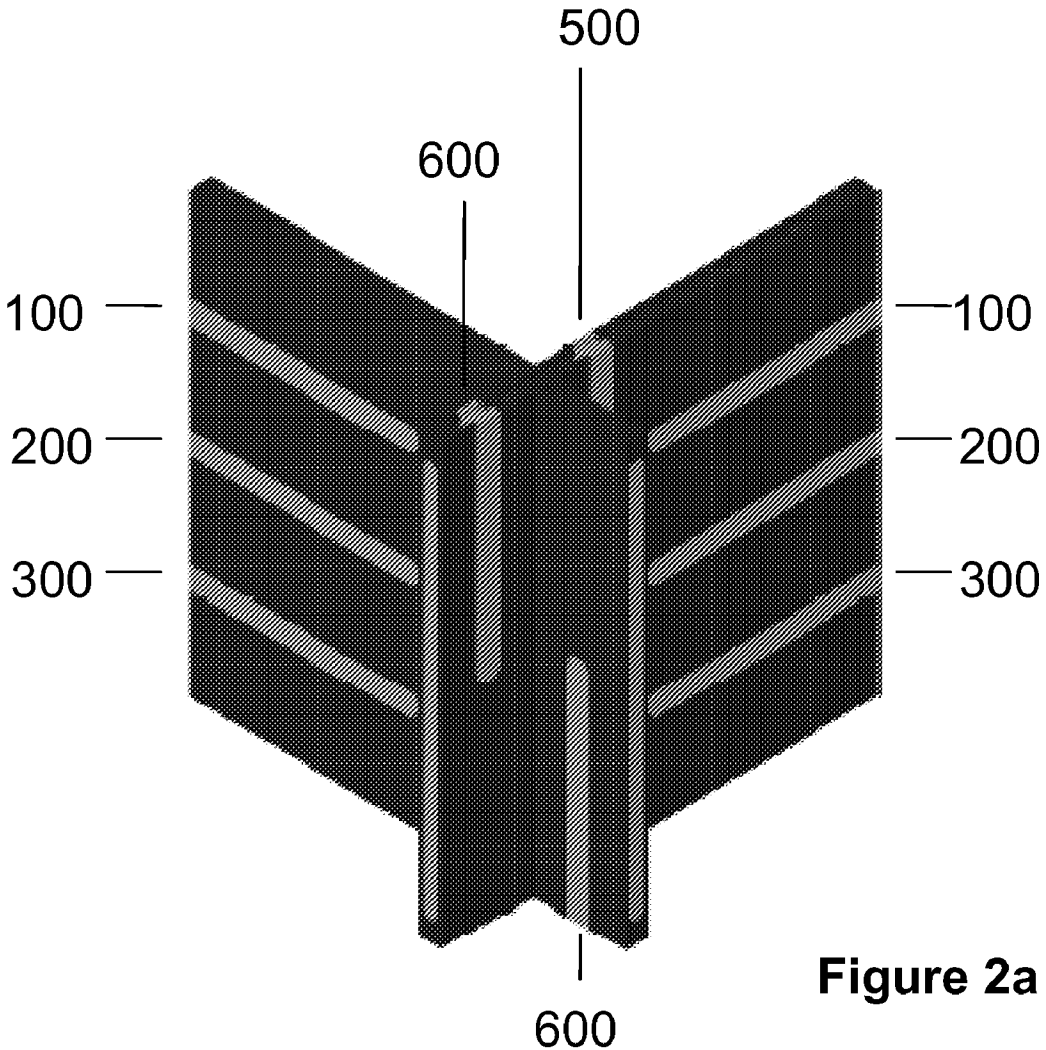
FIG. 2*a* shows the opening or elongated slots carved out of the panels for interlocking one panel to another.

Referring now to FIG. 1, there is shown a piece of panel that can be used as the building block to construct a piece of furniture such as a dining table, a coffee table, a book shelf, a bed, etc. Such panel is rectangular in shape (including squares). The material for the panel can be plastic, wood, glass, metal, or other types of material that is known to one of ordinary skill in the art. The panel can also be made solid or hollow, as shown in FIG. 1*a* and FIG. 1*b*. The panel contains a number of opening or elongated slots that extend perpendicularly from the edges of the panel (100, 200, 300, 400, 500, and 600). As shown in FIG. 2, the opening or elongated slots carved out of the panels are used for interlocking one panel to another. The length of an elongated slot is preferably equal to half of the length of the edge of the panel to which the elongated slot runs parallel so that the interlocked panels provide a leveled fit, as shown in FIG. 2. In another embodiment, the terminal end of the slot that is distal from the edge is preferably round and extends slightly beyond the half length point to make it aesthetic.

Figure 2B:
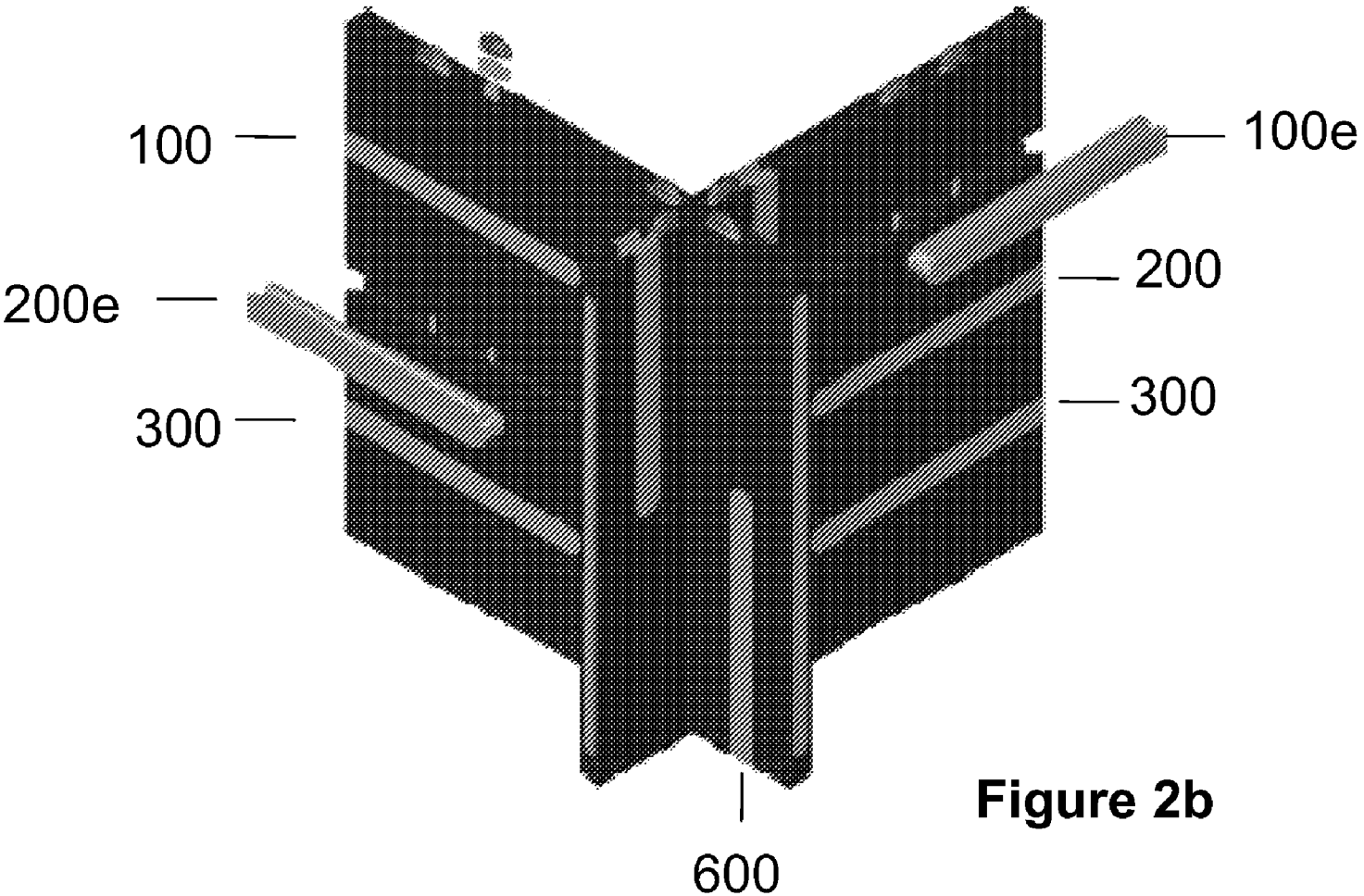
FIG. 2*b* shows the panel as containing a number of drilled holes.

As shown in FIG. 2*b*, the panel may also contain a number of holes drilled from one reference edge of the panel and runs perpendicular through the length of the panel till another reference edge of the panel. Metal bars of various configurations may be used to thread through the holes to enforce the strength and durability of the panel. The inserted metal bars take the weight of the panel it carries. The metal bars may also re-enforce the connections of two or more panels when necessary. In addition, rubber tips may be applied to the ends of the metal bars. The function of such rubber tips is versatile. It smoothes the contacts between the furniture components and further protects the furniture components from scratches or heavy weight.

Figure 3:
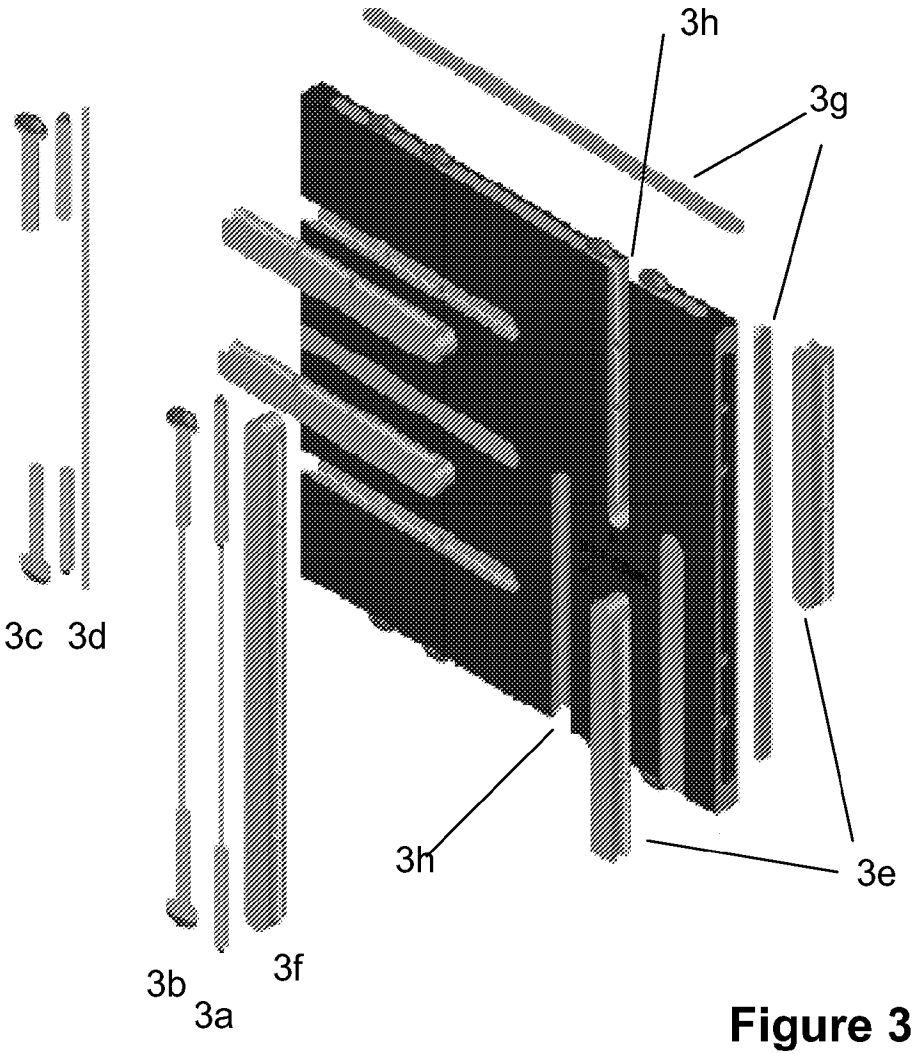
FIG. 3 shows a side and perspective view of a modular panel of one of the embodiments of the present invention, having various accessory elements to be used in connection with the modular panel.

FIG. 3 provides a more detailed three dimensional view of the panel and its various elements. As the Figure shows, the panel has six openings or elongated slots that cut perpendicular into three of its reference edges. Three openings or elongated slots extend from a first reference edge, the vertical edge of the panel that is facing away from the drawing, and runs in the horizontal direction, or parallel to one side of the panel, as shown in FIG. 3. One of these openings or elongated slots is located at approximately the midpoint of said first reference edge. The other two are located at approximately the one quarter and three-quarter points of said first reference edge. There are three more openings or elongated slots that extend from either a second reference edge and a third reference edge and run in the vertical direction. The second reference edge is the upper horizontal edge of the panel shown in FIG. 3, and the third reference edge is the bottom edge. One of the three openings or elongated slots extends from said second reference edge, and the other two extends from said second reference edge. Preferably, the location for the opening or elongate slot in said second reference edge is at a three-quarter point, and the locations for the openings or elongated slots are at respectively a three-eighth point and a seven-eighth point.

The panel could also have drill holes that run across the length of the sides of the panels. The bore of these drill holes are preferably small in relation to the thickness of the panel so as not to harm the integrity of the panel itself. Metal bars may be used to thread through the drill holes to enforce the strength and durability of the panel. Longer metal bars could also be used to connect different panels to each other. Half-sphere shaped or oblong-half-sphere shaped rubber cushions are provided at the distal ends of the metal bar. The function of such rubber cushions is versatile. It provides gripping force between the horizontal and vertical modular panels as disclosed in this invention. It also smoothes the contacts between the components of a piece of furniture constructed from the panels disclosed in this invention and further protects the furniture components from scratches or heavy weight.

FIG. 3 also includes additional accessory elements that can be used in conjunction with the panels disclosed in this invention. For example, one could use a single slot filler to fill in the elongated slots that are cut out, or use a double slot filler to fill in the elongated slots and connect two panels together. Again, the material for the slot fillers can be plastic, wood, glass, metal, or other types of material that is known to one of ordinary skill in the art. The size and shape of a single slot filler should correspond to the size and shape of the elongated slot so that the slot can be filled in. The length of a double slot filler should be twice the size of a single slot filler. Such double slot filler could be used to connect two modular panels together. In addition, the edges of the panels could also be covered with side panel covers if the rubber cushions are not used.

Figure 6:
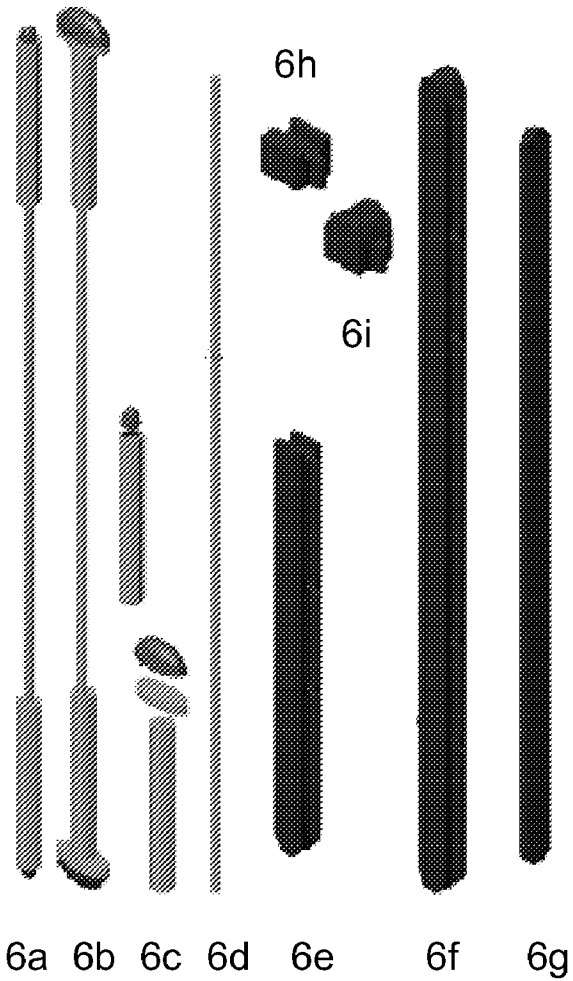
FIG. 6 shows an enlarged view of the various accessory elements that can be used in connection with embodiments of the present invention.

FIG. 6 provides further illustration of these accessory elements. FIG. 6*a*-6*c* show configurations of the metal bars comprised of a slim steel rod that is encapsulated in both ends by cylindrical tubes. The tip ends of the bar are further covered by rubber cushions that have either half-sphere or oblong-half-sphere shapes. FIGS. 6*e*, 6*f*, 6*h*, and 6*i* show a single slot filler having various configurations. It can be a single solid piece as shown in FIG. 6*e*, or have either a flat end shown in FIG. 6*h* or a rounded end shown in FIG. 6*i*. FIG. 6*f* shows a double slot filler. The round-end (FIG. 6*i*) or the flat-end (FIG. 6*h*) pieces are provided so that the slot filler would dovetail a slot having a matching configuration with recessed round ends. Both the single and double slot fillers has a protruding (FIG. 3: 3*f* or FIG. 6: 6*e*/6*f*) sides on the either side of the fillers. This is to fit snugly when inserted into the slots (FIG. 8) where there are notches on the either side of the slot. FIG. 6*g* shows an exemplary configuration for a side panel cover.

Figure 7:
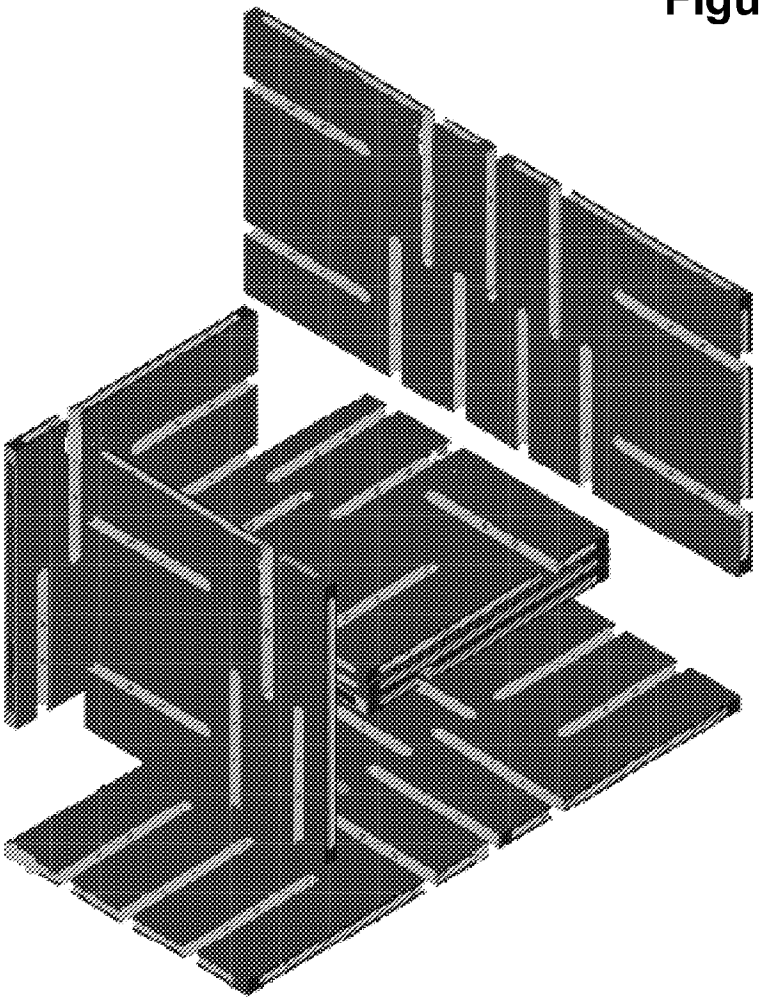
FIG. 7 illustrates an exemplary packing of embodiments of the present invention for easy storage.

Preferably, the locations of the elongated slots and drill holes inside the panels are pre-determined and uniform so that it allows for manufacture in mass quantities and easy assembly. The locations of the elongated slots at the reference edges from which the slots extend are preferably selected at half-point, quarter points, and one-eighth points of the reference edges, adjusted slightly to accommodate the width of the slot which substantially equals the thickness of the panels. The symmetry built into these slots makes the interlocking of such panels easy and precise. It is also preferred that the panels that are used to construct a piece of furniture have a uniform or standardized dimension. This way the panels can be tightly compacted. FIG. 7 shows how the various modular panels with uniform dimensions can be packed together.

Figure 4A:
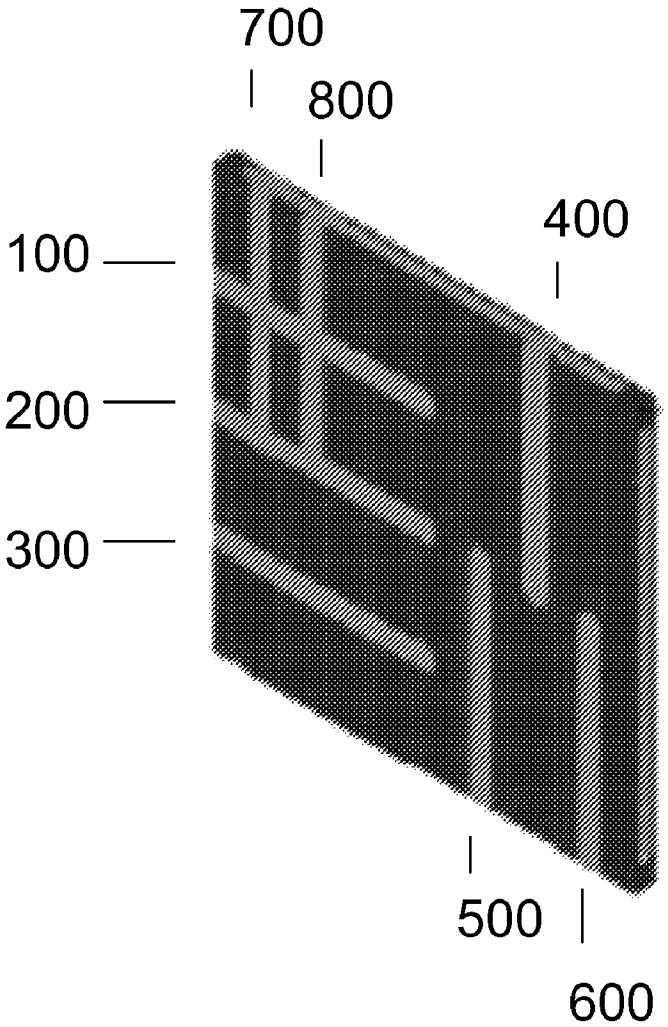
FIG. 4*a* shows different arrangements of the slots and drill holes in a substantially square panel.
Figure 4B:
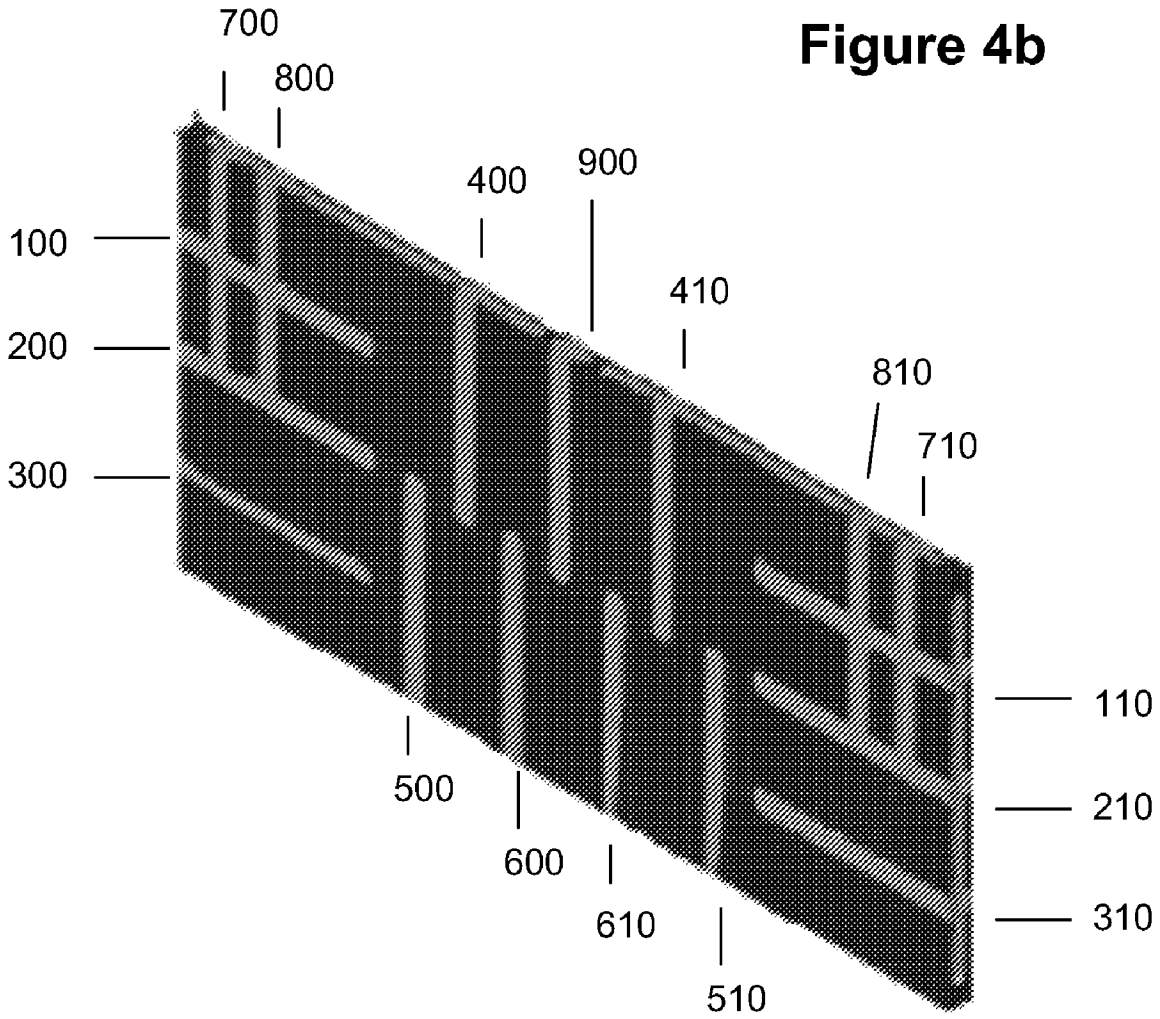
FIG. 4*b* shows another arrangement of the slots and drills holes in a substantially rectangular panel.
Figure 5A:
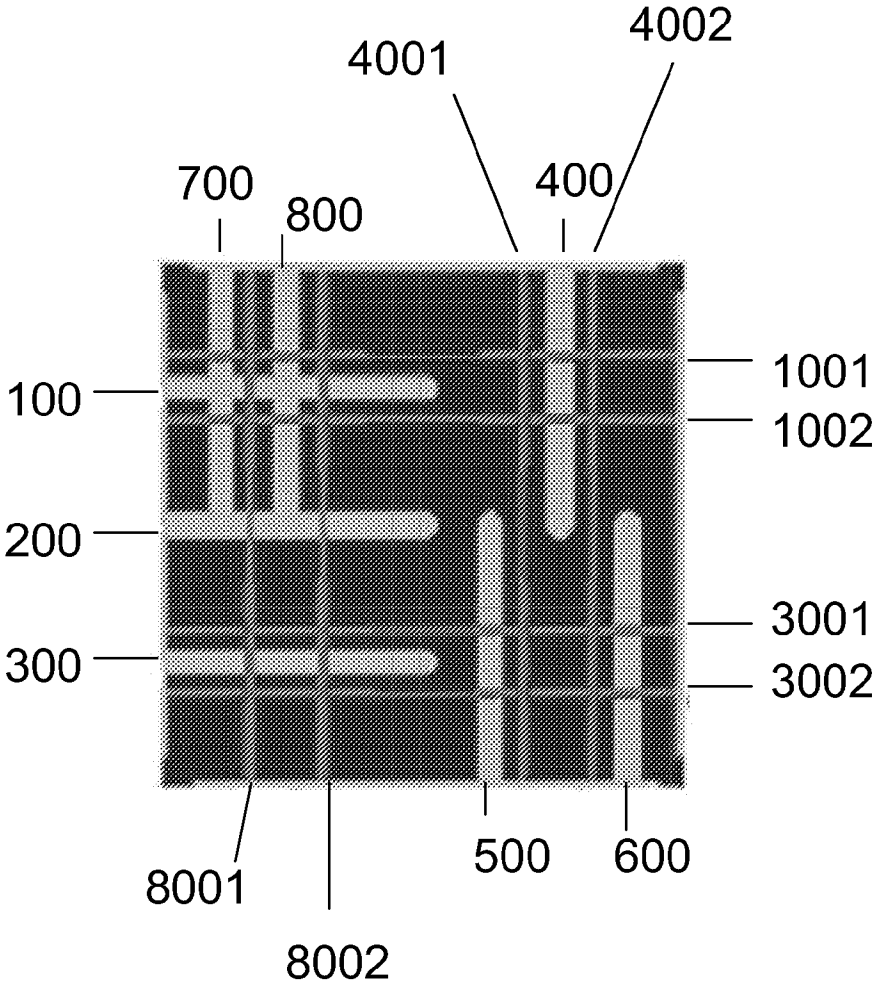
FIG. 5*a* depicts a cross-sectional view of the substantially square panel shown in FIG. 4*a*.

FIGS. 4 & 5 illustrate preferred arrangements of the slots and drill holes in the panels. FIG. 5*a*, which provides a cross-section view of an embodiment of the panel, designates the following slot and drill hole locations: slot 100, slot 200, slot 300, slot 400, slot 500, slot 600, slot 700, and slot 800; drill hole 1001, drill hole 1002, drill hole 3001, drill hole 3002, drill hole 4001, drill hole 4002, drill hole 8001, and drill 8002. As an initial matter, provided below is a list of all the keys and terms that will be used to define the formula of the design of the panel that can have variable combinations of the slots based upon dimensions of an rectangular panel.

| Terms | Key | Descriptions of the Key or Terms |
|---|---|---|
| First Reference Edge | | The left vertical edge of the panel shown in FIG. 5. |
| Second Reference Edge | | The top horizontal edge of the panel shown in FIG. 5. |
| Length of a first reference edge | X | The length of the First Reference Edge of the panel shown in FIG. 5 |
| Length of a second reference edge | Y | The length of the Second Reference Edge of the panel shown in FIG. 5. |
| Thickness | T | The dimension of the thickness of the panel is preferably between 1 to 8 percentage of X. |
| Half-Thickness | @ | Half of T |
| Slot Location | S | The distance of the slot as measured from either the First Reference Edge or the Second Reference Edge of the panel |
| Drill hole location | D | The distance of the drill hole as measured from either the First Reference Edge or the Second Reference Edge of the panel |
| Drill-Hole Finder | U | This key "U" equals for half of ($S_{600} - S_{400}$) |

The locations of the slots and drill holes can be calculated according to the following formulas.

Description of the Formula for the Location of the Slots where X = Y

| Slot | | Slot location measured as a percentage point of either the First Reference Edge or the Second Reference Edge | |
|---|---|---|---|
| Location | Formula | T = 5% of X | T = 3% of X |
| $S_{100}$ | (X/2 − @)/2 | 23.75 | 24.25 |
| $S_{200}$ | X/2 | 50 | 50 |
| $S_{300}$ | X − $S_{100}$ | 76.25 | 75.75 |
| $S_{400}$ | Y − $S_{800}$ | 76.25 | 75.75 |
| $S_{500}$ | Y/2 + ((Y/2 + @)/4) | 63.125 | 62.875 |
| $S_{600}$ | Y − $S_{700}$ | 89.375 | 88.625 |
| $S_{700}$ | ((Y/2 − @)/2 − @)/2 | 10.625 | 11.375 |
| $S_{800}$ | (Y/2 − @)/2 | 23.75 | 24.25 |

Description of the Formula for the Location of the Drill-Holes where X = Y

| Drill-Hole | | Drill hole location measured as a percentage point of either the First Reference Edge or the Second Reference Edge | |
|---|---|---|---|
| Locations | Formula | T = 5% of X | T = 3% of X |
| $D_{1001}$ | $S_{100}$ − u | 17.1875 | 17.8125 |
| $D_{1002}$ | $S_{100}$ + u | 30.3125 | 30.6875 |
| $D_{3001}$ | $S_{300}$ − u | 69.6875 | 69.3125 |
| $D_{3002}$ | $S_{300}$ + u | 82.8125 | 82.1875 |
| $D_{4001}$ | $S_{400}$ − u | 69.6875 | 69.3125 |
| $D_{4002}$ | $S_{400}$ + u | 82.8125 | 82.1875 |
| $D_{8001}$ | $S_{800}$ − u | 17.1875 | 17.8125 |
| $D_{8002}$ | $S_{800}$ + u | 30.3125 | 30.6875 |

Length and the Diameters of the Drill-Holes

Figure 5B:
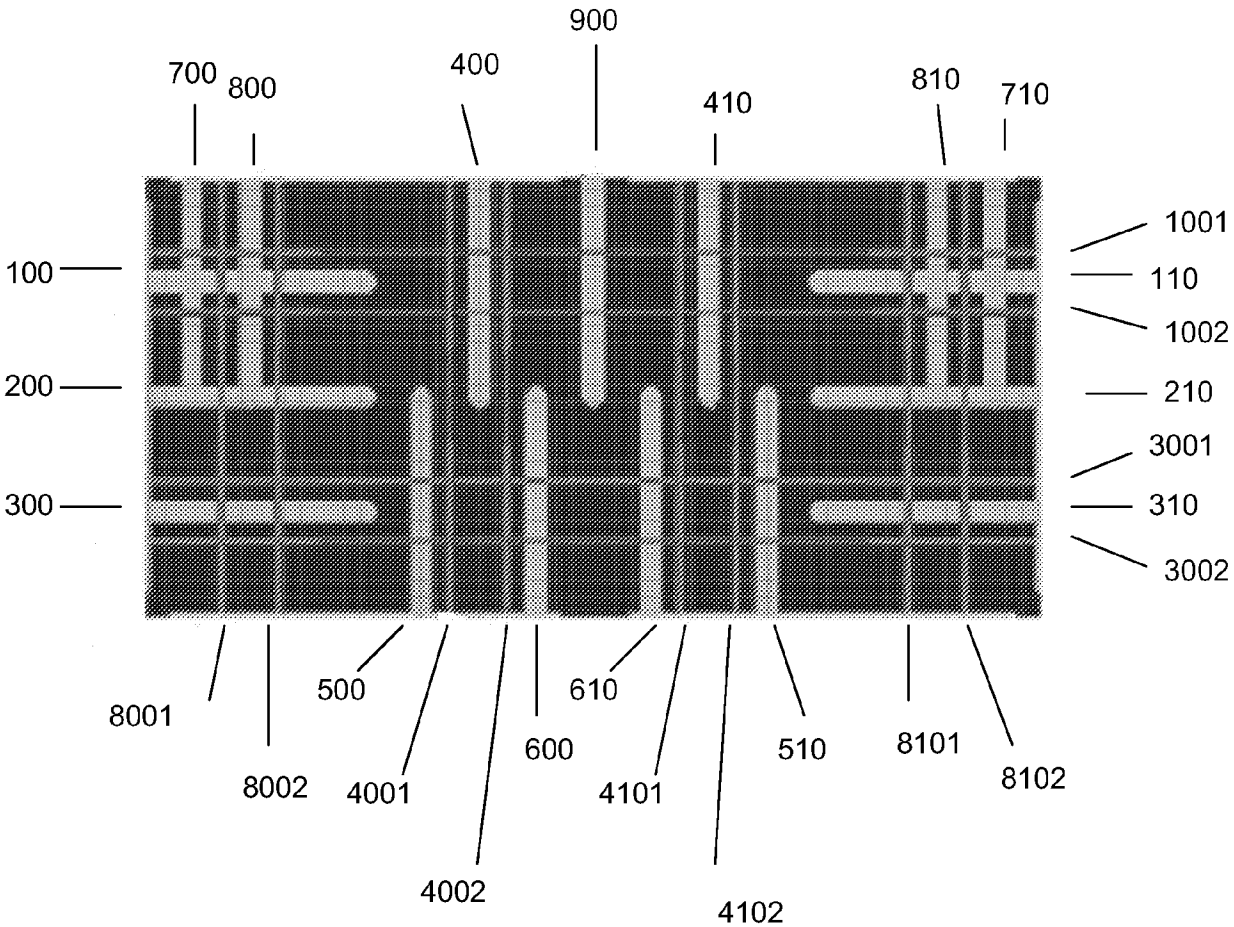
FIG. 5*b* depicts a cross-sectional view of the substantially rectangular panel shown in FIG. 4*b*.

Description of the Formula for the Length and the Diameters of the Drill-Holes (FIG. 5a & 5b)

| Description | Formula | T = 5% of X | T = 3% of X |
|---|---|---|---|
| Length of the broader part of the drill-holes, that is the portion of drill-holes starting from the edge of the plane to the center of the plane | X − $S_{500}$ − @ | 34.375 | 34.625 |
| Diameter of the broader (above) segment | T/5x3 | 3 | 3 |
| Diameter of the thinner segment | T/5x2 | 2 | 2 |

Dimensions in Notches in the Slots and Protrusion on the Slot-Fillers

Description of the Formula for the Length and the Diameters of the Notches in the Slots and the Protrusion on the sides of the Slot-Fillers (FIG. 3: 3f, 3e, and 3h)

| Description | Formula | Dimension |
|---|---|---|
| Rounded notches (with the same dimension in the depth of the notches) | T/5x1 | 1 |
| Protrusion on the sides of the slot-fillers (with the same dimension in the thickness of the protrusion) | T/5x1 | 1 |

Figure 10:
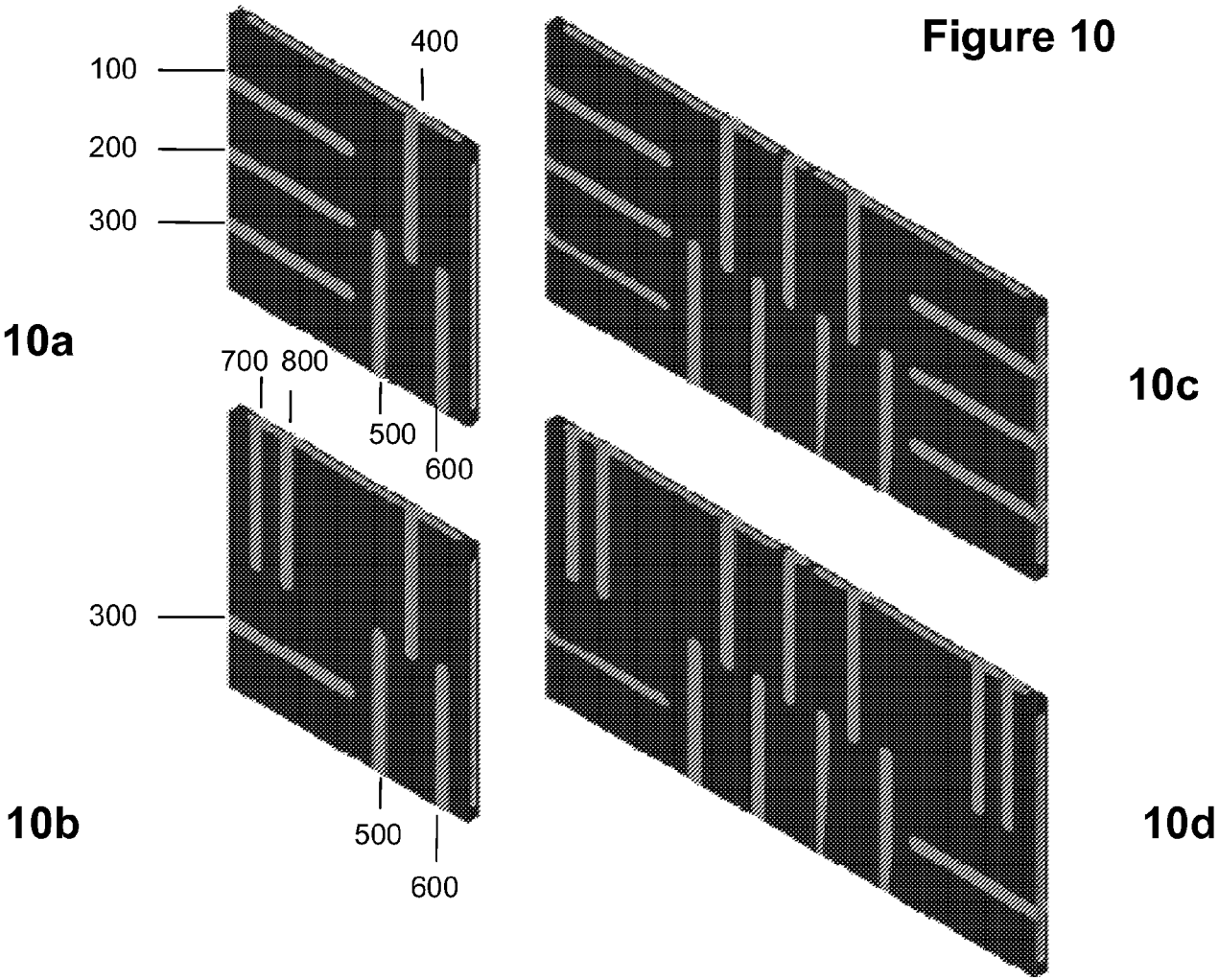
FIG. 10 shows a perspective view of a plurality of modular panels constructed according to the concepts and principles disclosed in embodiments of the present invention.

As described earlier, the panels disclosed in FIG. 5 do not need to have all eight elongated slots 100, 200, 300, 400, 500, 600, 700, and 800 cut out for it to function as a modular piece. While having all elongated slots would make a panel versatile and facilitate its interconnections with multiple other panels to make more complex furniture arrangement, only two slots are required. Preferably, a panel should have one slot 200, and another slot 400. A panel with such configuration is the most versatile as a building block for a modular styled furniture built according to the concepts and principles of the present invention. Yet another embodiment would have elongated slots 100, 200, 300, 400, 500, and 600, as shown in FIG. 10*a*. Yet another embodiment would have elongated slots 300, 400, 500, 600, 700, and 800, as shown in FIG. 10*b*.

In yet another embodiment of this invention, a panel can be made that is twice the size of the panel that is depicted on FIG. 5*a*. The configurations of the slots and drill holes in one such panel are illustrated on FIG. 5*b*. As the figure demonstrates, the panel is essentially a combination of two panels depicted on FIG. 5*a* placed next to each other in a mirror image. Therefore, the panel would have an extra set of slots (slots 110, 210, 310, 410, 510, 610, 710, and 810) and an extra set of drill holes (drill holes 4101, 4102, 8101, and 8102). The location of the extra sets of slots and drill holes mirrors the set of slots and drill holes in the leaf half part of this panel. In addition, an extra slot, slot 900 is provided in the middle of the long edge of this twin-panel. An extra length that equals to the thickness of the panel is added in between the two mirror images to allow for the addition of slot 900. In other words, the length of this twin-panel is 2Y+T.

Figure 8:
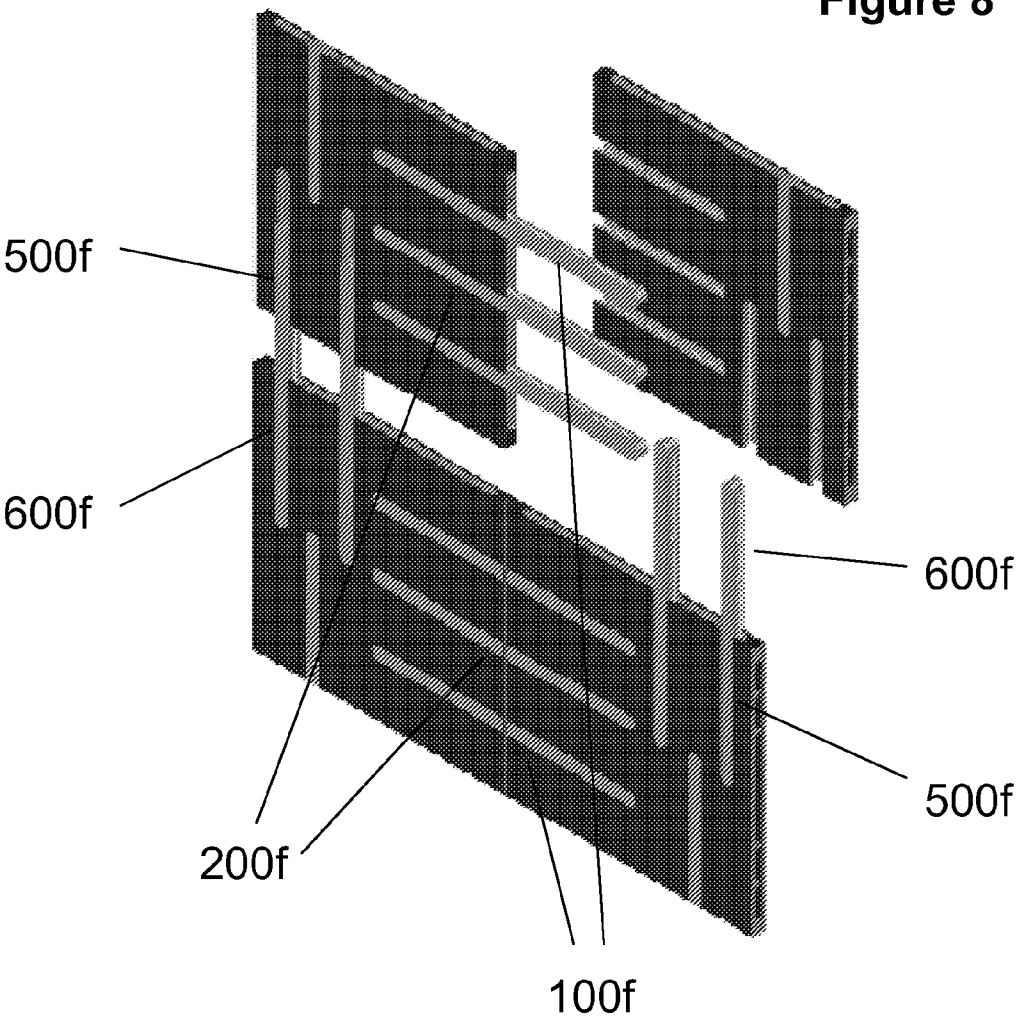
FIG. 8 shows one of the embodiments of the present invention whereby small panels can be combined to form a large panel.

In yet another embodiment of this invention, bigger planar combination panels can be constructed by connecting a number of panels with double length slot fillers. Shown on FIG. 8 is an example where four square panels by the size of X*X can be combined together for form a bigger square panel by the size of 2X*2X.

Figure 9:
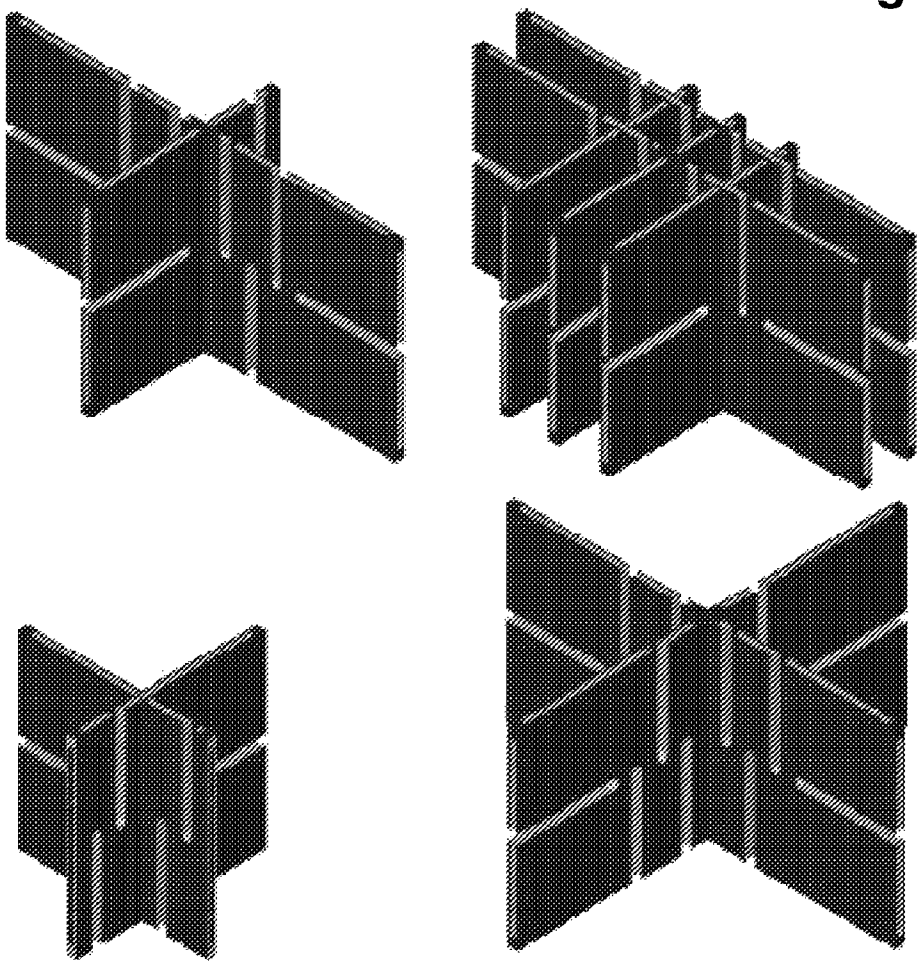
FIG. 9 shows various ways by which modular panels can be combined with each other to form bigger and complex furniture structures.

The versatility of how these panels can be engaged to one another to form complex furniture arrangement is further illustrated in FIG. 9.

It is noted that the use of panels is not limited to the construction of modular styled furniture such as tables, bookshelves, beds, and sofa etc. One can construct a cup holder or ornamental structures if the size of the modular panels is small. It can also be used as desk organizer of various sorts. Finally, a miniature panel can be used by young children as toys.

It is appreciated that the dismantled panels are storable, transferable and pack-able into nearly a 100% compactness of the item itself, thus creating, by default, the benefit of allowing users in schools, homes, apartment, business, studio spaces alike a multipurpose access to the floor space. The storage of the panels would not take up too much storage place. In addition, the panels can be easily loaned, shared, and moved in parts among the users, thus preventing wastes often associated with used furniture.

While the invention herein disclosed has been described by means of specific embodiments and applications thereof, other modifications, variations, and arrangements of the present invention may be made in accordance with the above teachings other than as specifically described to practice the invention within the spirit and scope defined by the following claims.

We claim:

1. A set of panels for assembling a larger system, comprising:

first and second rectangular panels each having a thickness of T, wherein each rectangular panel comprises a first reference edge, a second reference edge, a third reference edge, and a fourth reference edge adjacent to each other; and further wherein each rectangular panel comprises:

a first opening extending into said rectangular panel from the first reference edge and substantially parallel to the second reference edge, wherein the first opening is an elongated slot with a length substantially equal to at least ½ of the second reference edge, and wherein the first opened at a distance from the second reference edge that substantial equals ⅛, or ¼, or ⅜, or ½, or ⅝, or ¾, or ⅞ of the length of the first reference edge;

a second opening extending into said rectangular panel from the second reference edge and substantially parallel to the first reference edge, wherein the second opening is an elongated slot located at a distance from the first reference edge that substantially equals ⅛, or ¼, or ⅜, or ½, or ⅝, or ¾, or ⅞ of the length of the second reference edge;

wherein said first opening does not intersect said second opening;

further wherein the first rectangular panel comprises a length for the first reference edge substantially equal to X, and a length for the second reference edge substantially equal to X;

further wherein the second rectangular panel comprises a length for the first reference edge substantially equal to X, and a length for the second reference edge that substantially equals Y, wherein Y is at least 2X;

further wherein T is 1 to 8% of X; and a plurality of slot fillers adapted for assembling the at least two rectangular panels, said plurality of slot fillers comprising at least one single slot filler and at least one double slot filler, with each filler having a size and shape corresponding to each elongated slot so that the slot can be filled in; wherein the panels can be arranged between first and second configurations; wherein in the first configuration, the slots connect the panels together such that the panels are interlocked and substantially perpendicular to each other; and in the second configuration, said at least one double slot filler connects the panels together such that the panels are substantially coplanar.

2. The set of panels of claim 1 wherein each of the width of said elongated slots is substantially uniform.

3. The set of panels of claim 1 wherein each of the width of said elongated slots is substantially the same as T.

4. The set of panels of claim 1 wherein each of the width of said elongated slots is slightly larger than T.

5. The set of panels of claim 1 wherein the width of said first opening and said second opening is substantially uniform.

6. The set of panels of claim 1 comprising a third opening.

7. The set of panels of claim 6 comprising a fourth opening.

8. The set of panels of claim 7 comprising a fifth opening.

9. The set of panels of claim 8 comprising a sixth opening.

10. The set of panels of claim 1, wherein one of said elongated slots comprises a flat end, and at least one of said slot fillers comprises a flat end.

11. The set of panels of claim 1, wherein one of said elongated slots comprises a rounded end, and at least one of said slot fillers comprises a rounded end.

12. The set of panels of claim 1, wherein at least one of said slot fillers comprises a protruding side on both edges comprising a length substantially equal to T/5.

13. A large system assembled from panels comprising:

at least two rectangular panels having a thickness of T, each rectangular panel comprising a first reference edge, a second reference edge, a third reference edge, and a fourth reference edge adjacent to each other; and further wherein each rectangular panel comprises:

a first opening extending into said rectangular panel from the first reference edge and substantially parallel to the second reference edge, wherein the first opening is an elongated slot with a length substantially equal to at least ½ of the of the length of the second reference edge, and wherein the first opening is located at a distance from the second reference edge that substantially equals ⅛, or ¼, or ⅜, or ½, or ⅝, or ¾, or ⅞ of the length of the first reference edge;

a second opening extending into said rectangular panel from the second reference edge and substantially parallel to the first reference edge, wherein the second opening is an elongated slot located at a distance from the first reference edge that substantially equals ⅛, or ¼, or ⅜, or ½, or ⅝, or ¾, or ⅞ of the length of the second reference edge;

wherein said first opening does not intersect said second opening;

further wherein the at least two rectangular panels each comprise a length for the first reference edge substantially equal to X;

further wherein T is 1 to 8% of X; and a plurality of slot fillers adapted for assembling the at least two rectangular panels, said plurality of slot fillers comprising at least one single slot filler and at least one double slot filler, with each filler having a size and shape corresponding to each elongated slot so that the slot can be filled in; wherein the panels can be arranged between first and second configurations; wherein in the first configuration, the slots connect the panels together such that the panels are interlocked and substantially perpendicular to each other; and in the second configuration, said at least one double slot filler connects the panels together such that the panels are coplanar.

14. The large system of claim 13 wherein at least one of the rectangular panels comprises a length for the second reference edge substantially equal to Y, wherein Y is greater than X.

15. The large system of claim 13 wherein the width of said first opening and second opening is substantially uniform.

16. The large system of claim 13 wherein the width of said slots is substantially the same as T.

17. The large system of claim 13 wherein the width of said slots is slightly larger than T.

18. The large system of claim 13 wherein at least one of said rectangular panels having one or more drill holes that extends from one edge of the panel to the other edge.

19. The large system of claim 13, wherein the elongated slot comprises a flat end, and at least one of said slot fillers comprises a flat end.

20. The large system of claim 13, wherein the elongated slot comprises a rounded end, and at least one of said slot fillers comprises a rounded end.

21. The large system of claim 13, wherein at least one of said slot fillers comprises a protruding side on both edges comprising a length substantially equal to T/5.

* * * * *